US007784833B2

(12) United States Patent
Tsuchie

(10) Patent No.: US 7,784,833 B2
(45) Date of Patent: Aug. 31, 2010

(54) ROLLER SKIS

(76) Inventor: Kimihiro Tsuchie, 35-1, Kinugasa Tenjinmori-cho, Kita-ku, Kyoto-shi (JP)

( * ) Notice: Subject to any disclaimer, the term of this patent is extended or adjusted under 35 U.S.C. 154(b) by 472 days.

(21) Appl. No.: 11/784,712

(22) Filed: Apr. 9, 2007

(65) Prior Publication Data

US 2007/0257460 A1 Nov. 8, 2007

(30) Foreign Application Priority Data

May 8, 2006 (JP) ..... 2006-156617
Oct. 24, 2006 (JP) ..... 2006-288270

(51) Int. Cl.
*A63C 17/02* (2006.01)

(52) U.S. Cl. ..... 280/842; 280/11.19; 280/11.28; 280/87.042

(58) Field of Classification Search ..... 280/8, 280/11.19, 11.232, 11.27, 11.28, 87.01, 87.021, 280/87.03, 87.041, 87.042, 87.05, 842; D21/760, D21/763, 764, 765
See application file for complete search history.

(56) References Cited

U.S. PATENT DOCUMENTS 1,327,123 A * 1/1920 Thomas ..... 280/87.021
2,253,012 A * 8/1941 Benner et al. ..... 280/842
3,827,706 A 8/1974 Milliman
4,029,330 A * 6/1977 Runyan, Jr. ..... 280/87.042
4,134,598 A * 1/1979 Urisaka ..... 280/842
4,886,298 A 12/1989 Shols
5,096,225 A * 3/1992 Osawa ..... 280/842
5,195,781 A * 3/1993 Osawa ..... 280/842
5,984,328 A * 11/1999 Tipton ..... 280/87.042
6,910,698 B2 * 6/2005 Turner et al. ..... 280/87.042
7,341,271 B2 * 3/2008 Bunter ..... 280/602
2003/0173751 A1 * 9/2003 Shih ..... 280/11.19

FOREIGN PATENT DOCUMENTS

JP 02-255168 8/1990
JP 08-206273 8/1996
JP 2001-145720 5/2001

* cited by examiner

*Primary Examiner*—Paul N Dickson
*Assistant Examiner*—Brodie Follman
(74) *Attorney, Agent, or Firm*—William L. Androlia; H. Henry Koda

(57) ABSTRACT

A pair of roller skis each comprising at least four fixed rollers disposed in parallel on the central lower face of a long and narrow board made of an elastic material while having a left-right spacing corresponding to the width of the board and while having a front-rear spacing shorter than the front-rear length of a boot secured to the board, and two casters, one disposed on the lower face of the top portion of the board and the other disposed on the lower face of the tail portion of the board, wherein when the board is placed on the ground with no load applied thereto, only the rollers of the top and tail casters make contact with the ground and the fixed rollers at the central portion are away from the ground. With this configuration, it is possible for the user to enjoy or practice skiing on slopes with no snow while having sliding feelings and using sliding techniques similar to those of snow skiing.

3 Claims, 2 Drawing Sheets

ROLLER SKIS

BACKGROUND OF THE INVENTION

1. Field of the Invention

The present invention relates to a pair of roller skis each having several rollers installed on the bottom of a long and narrow board so that skiing is made possible in a way similar to that of ordinary skiing (hereafter referred to as snow skiing) during the off-season when there is no snow.

2. Description of the Prior Art

Numerous products and proposals have been disclosed as this kind of roller skis. Among these conventional arts, roller skis particularly akin to the roller skis according to the present invention are those described in Japanese Patent Application Laid-Open Publication No. H8-206273 and Japanese Patent Application Laid-Open Publication No. 2001-145720. However, the sliding feelings of the roller skis and the sliding techniques required therefor described in these documents are different from those of skis used on the snow, and the roller skis cannot serve as a substitute for actual snow skis.

SUMMARY OF THE INVENTION

The present invention is intended to provide a pair of roller skis capable of allowing the user to enjoy skiing during the off-season when there is no snow or to practice skiing in preparation for the skiing season, on gentle slopes of asphalt or concrete, while having sliding feelings and using sliding techniques similar to those in snow skiing.

To attain the above-mentioned object, the roller skis according to the present invention each comprise a long and narrow board made of an elastic material; boot fixtures installed on the central upper face of the board; at least four fixed rollers disposed in parallel on the central lower face of the board so as to be directed in the rotating direction in the longitudinal direction of the board while having a left-right spacing corresponding to the width of the board and while having a front-rear spacing shorter than the front-rear length of a boot secured to the boot fixtures, thereby to form a rectangular ground contact plane in which the ground contact points of the fixed rollers serving as front wheels and the fixed rollers serving as rear wheels are used as the apexes thereof; two casters, the direction of which is changeable as desired, one disposed on the lower face of the top portion of the board and the other disposed on the lower face of the tail portion of the board, wherein when the board is placed on the ground with no load applied thereto, only the rollers of the top and tail casters make contact with the ground and the fixed rollers at the central portion are away from the ground.

The configuration described above in which when the board is placed on the ground with no load applied thereto, only the rollers of the top and tail casters make contact with the ground and the fixed rollers at the central portion are away from the ground can be attained by selectively determining the positions of the rollers so that the distance from the lower face of the board to the ground contact points of the rollers of the casters is larger than the distance from the lower face of the board to the ground contact points of the fixed rollers or by using a board curved so as to become convex upward.

The specific configuration and function of the roller skis according to the present invention will become apparent referring to the following description relating to an embodiment thereof. Like general snow skis, the roller skis according to the present invention are usually used in pairs, and only one of the pair is shown in the drawings.

DETAILED DESCRIPTION OF THE PREFERRED EMBODIMENTS

Figure 1:
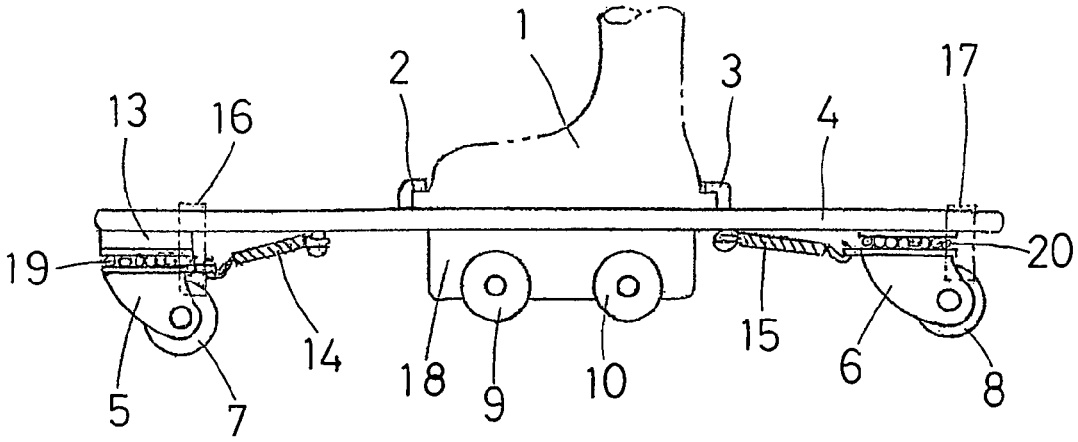
FIG. 1 is a side view showing an embodiment of a roller ski according to the present invention.

Referring to the drawings, a board 4 is an elastic wooden board measuring approximately 90 cm in length, approximately 6 cm in width and approximately 1.2 cm in thickness. Binders 2 and 3 for holding a boot 1 (indicated by two-dot chain lines) at the front and rear ends thereof are disposed on the central upper face of the board 4. A roller base 18 is disposed on the central lower face of the board 4. Four fixed rollers 9, 10, 11 and 12 capable of rotating independently of one another are installed on the roller base 18 while having a left-right spacing corresponding to the width of the board 4 and having a front-rear spacing shorter than the front-rear length of the boot so as not to make contact with the boot and the board 4. In addition to wood, any material having sufficient strength and elasticity suited for the board of a roller ski, such as a plastic or a metal, can be used as the material of the board 4.

Casters 5 and 6 with rollers 7 and 8 are installed at the top portion and the tail portion of the board 4, respectively. The size and installation height of each roller are selectively determined so that the distance from the lower face of the board 4 to the ground contact points of the rollers 7 and 8 of the casters 5 and 6 is larger than the distance from the lower face of the board 4 to the ground contact points of the fixed rollers 9, 10, 11 and 12. In other words, when the board 4 is placed on the ground with no load applied thereto, the fixed rollers 9 to 12 disposed at the central portion of the board 4 are away from the ground. When the user gets on the board 4, the board 4 is bent in an arch shape, and the fixed rollers 9 to 12 make contact with the ground. With this bending, the repulsive force of the board 4 is enhanced, thereby securely supporting the loads applied to the top portion and the tail portion. All the rollers 7, 8, 9 to 12 are each preferably equipped with a bearing for smooth rotation, and the casters 5 and 6 are equipped with bearings 19 and 20, respectively, for smooth change of direction. In addition, general-purpose rollers being used conventionally for inline skis, carriers, etc. can be used appropriately for the fixed rollers 9 to 12 and the rollers 7 and 8 of the casters.

Furthermore, a spacer 13 is interposed between the caster 5 of the top portion and the board 4 so that the distance from the lower face of the board 4 to the ground contact point of the roller 7 is larger than that in the case of the roller 8 of the caster 6. This configuration is used to solve the problem described below. When the board 4 is tilted leftward to turn left, for example, the direction of the caster 5 changes as the board 4 turns as shown in the rear view of FIG. 3. Owing to the offset of the caster 5, the roller 7 moves rightward, and the ground contact pressure of the roller 7 lowers, that is, the repulsive force of the board 4 lowers. For the purpose of compensating for this lowering, the above-mentioned configuration is used to prevent the repulsive force of the board 4 at the time of turning from lowering and to securely support the load. Since the roller 8 of the tail caster 6 moves leftward as the board 4 turns, the action for raising the board 4 is enhanced, and the repulsive force of the board 4 during the turning increases.

When the casters 5 and 6 are free, the rollers 7 and 8 thereof are desired to be directed toward the movement direction of the board 4 at all times. For this purpose, tension springs 14 and 15 are installed between the casters 5 and 6 and the board 4 to provide tension. In addition, rotation stopping frames 16 and 17 are installed on both sides of the casters 5 and 6 as indicated by two-dot chain lines to limit the rotation of the casters 5 and 6 within a constant range.

Figure 2:
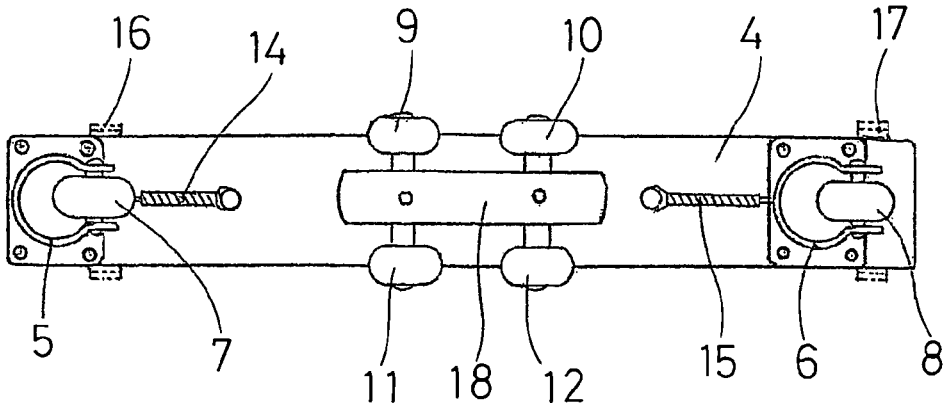
FIG. 2 is a bottom view showing the embodiment.
Figure 3:
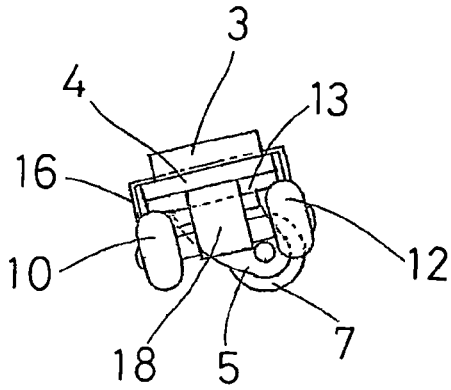
FIG. 3 is a rear view showing the main sections of the roller ski of the embodiment when the roller ski turns to the left.
Figure 4:
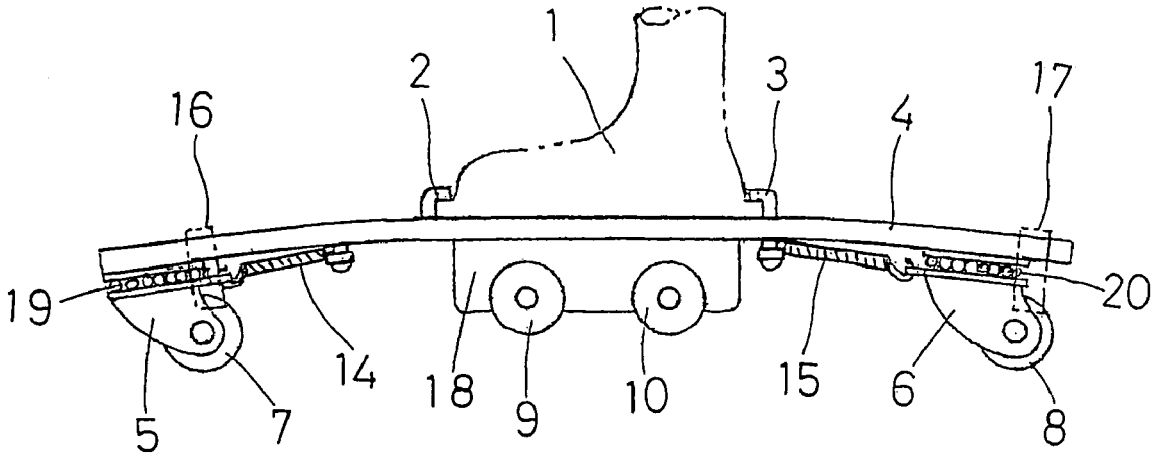
FIG. 4 is a side view of another embodiment of the roller ski according to the present invention.

Although the four fixed rollers 9 to 12 are installed in the embodiment shown in the drawings, it is possible to additionally install one or more pairs of fixed rollers between the fixed rollers 9 and 11 serving as front wheels and the fixed rollers 10 and 12 serving as rear wheels as necessary for the purpose of dispersing the load, for example. Furthermore, although the embodiment shown in FIGS. 1 through 3 is an example wherein a non-curved board is used as the board 4, it is also possible to obtain a roller ski having a function similar to that of the embodiment by using a board curved, as shown in FIG. 4, so as to become convex upward. Still further, the distance between the fixed rollers 9 and 11 serving as front wheels and the fixed rollers 10 and 12 serving as rear wheels should only be determined appropriately depending on the skiing level or taste of the user in reality because a rectangular ground contact plane having an appropriate size to the extent that the object of the present invention is not impaired should only be formed. For this purpose, it may also be possible to provide a mechanism capable of adjusting the distance in the front-rear direction. According to an experiment, the best result is obtained when the distance is appropriately half the length of the boot.

Next, the function of the roller skis according to the present invention will be described below. In recent skiing techniques, neutral position has become more important. The neutral position is defined as a posture wherein the user gets on the ski with the whole bottom of the foot, and the ski is not tilted sideways, that is, not in the edging state. The basic position at the time of start or at the time of the switching of turning corresponds to the neutral position. From this state, the leg is twisted to generate a turning force in the board around the foot, namely, a force for turning the board such that the top portion and the tail portion of the board are shifted sideways in opposite directions from each other. Various turning operations are started, triggered by this side shifting.

With the roller skis according to the present invention, the user can start skiing operations from the posture adjusted in the neutral position described above. In other words, when the roller ski is placed on the ground with no load applied to the board, only the rollers of the top and tail casters make contact with the ground, and the fixed rollers disposed at the central portion are away from the ground. When the user gets on the board by mounting his boot on the roller ski via the boot fixtures, the board is bent and its central portion lowers. Hence, the user can stand with all the fixed rollers being made contact with the ground. At this time, a rectangular ground contact plane is formed in which the ground contact points of the front and rear fixed rollers serve as the apexes thereof. As a result, all the rollers are uniformly loaded, and it is thus possible to obtain a state corresponding to the neutral position in which the user gets on a snow ski with the whole bottom of the foot. When the roller ski is tilted leftward or rightward from this state, only the fixed rollers on the tilted side remains contact with the ground, and the fixed rollers on the opposite side are away from the ground, resulting in a state exactly corresponding to edging in snow skiing.

Since the ground contact plane formed of the four ground contact points is a rectangle having a crosswise dimension corresponding to the width of the board, the front-rear dimension thereof being shorter than the front-rear length of the boot, the force for withstanding the rotation moment exerted when the leg is twisted to generate a turning force is small. It is thus possible to turn the board by shifting the fixed rollers sideways using a relatively small rotation moment. For this reason, even if the force for twisting the leg is small, the board can be turned easily to the left or right around the boot. Furthermore, since the board can be tilted in a way similar to that of the edging in snow skiing as described above, it is possible to perform operations, such as neutral position, side slipping and various turns while having feelings similar to those in snow skiing without feeling awkward, by appropriate combinations of side shifting, turning and tilting, and by appropriate movement of the position of the load inside the above-mentioned rectangular ground contact plane depending on the level of turning techniques. Still further, since the top and tail casters support the loads applied to the top and tail portions of the board so as to prevent the user from falling back and forth when the weight of the user is shifted back and forth, and change their directions as the board turns or shifts sideways, the top and tail casters do not obstruct the movement of the board.

As a result, with the combined effect of these, basic techniques, such as snow-plow, stem turn and snow-plow turn, as well as advanced techniques, such as various parallel turns, can be performed stably while having feelings similar to those in snow skiing. Unlike the roller skis described in the patent documents described above, the roller skis according to the present invention can allow the user to enjoy skiing during the off-season and to practice various turns while having sliding feelings and using sliding techniques similar to those in snow skiing.

This kind of function is not obtained from the conventional arts described above.

In other words, in the roller skis described in Japanese Patent Application Laid-Open Publication No. H8-206273, multiple pairs of main rollers are disposed in the front-rear direction on the central lower face of the board, each pair being formed of right and left main rollers. In addition, a pair of fall-prevention rollers and another pair of fall-prevention rollers are disposed on the lower face of the top portion and the lower face of the tail portion of the board, respectively, at positions slightly away from these main rollers. Furthermore, these rollers are disposed so as to make contact with an arc-shaped curve that is bent upward away from the horizontal line as the curve extends from the central portion to the top and tail end portions. Hence, when the load applied to the board is moved back and forth, the positions of the main rollers making contact with the horizontal line change depending on the position of the load. Each time the load is moved, the board itself rocks back and forth. As a result, the posture of the board changes and the board becomes very unstable. It is thus difficult to perform sliding in a balanced manner. Furthermore, since the fall-prevention rollers do not make contact with the ground usually, the fall-prevention rollers cannot support the loads applied to the top and tail portions of the board at all until the inclination of the board in the top-tail direction becomes large and one of the fall-prevention rollers makes contact with the ground. This leads to a problem that the user is liable to fall back and forth before turning is attempted. Hence, the sliding feelings using the roller skis are quite different from those of snow skiing, and various turns cannot be performed by directly applying the sliding techniques of snow skiing.

On the other hand, in the roller skis according to the present invention, even if the load is moved similarly as in the case of ordinary snow skiing, the posture of skiing remains unchanged and is stable at all times. Furthermore, since the loads applied to the top and tail portions are always supported by the repulsive force of the board, the problems described above are not caused at all.

In addition, in the roller skis described in Japanese Patent Application Laid-Open Publication No. 2001-145720, multiple main rollers are disposed in a row in the front-rear direction on the central lower face of the board. Furthermore, a caster is disposed on the lower face of the top portion of the board slightly away from these main rollers, and another caster is disposed on the lower face of the tail portion of the board near the main rollers. High straight running stability is obtained by the use of the multiple main rollers (six rollers in the embodiment thereof) disposed in a range considerably larger than the length of the boot, and the resistance force against the rotation moment generated when the leg is twisted is large. For these reasons, it is difficult to perform side shifting. The specification of the patent document describes that when the roller ski worn on the foot is tilted slightly in a turning direction, the direction of the top movable roller (caster) is changed to the turning direction, whereby the user can slide while changing directions as desired and while occasionally doing carving turns. However, the turning force obtained using the top movable roller is very small in comparison with the straight running force obtained using the multiple main rollers. As a result, it is obvious that the roller skis are hard to turn. It is conceivable that the roller skis can perform only a carving turn in which the radius of rotation is large and turning is done little by little. Hence, the sliding feelings are quite different from those of snow skiing, and various turns cannot be performed by directly using the sliding techniques of snow skiing.

On the other hand, in the roller skis according to the present invention, turning can be performed together with side shifting by rotating the board around the position of the foot just as in the case of ordinary snow skiing. It is thus possible to perform a sharp turn having a small radius of rotation.

Since the roller skis according to the present invention can perform operations, such as neutral position, edging, side slipping and various turns while having feelings similar to those in snow skiing without feeling awkward, the roller skis can be used to practice skiing during the off-season when there is no snow or in areas with no snow, and can also be used as a sports gear serving as a substitute for ordinary snow skis.

What is claimed is:

1. A pair of roller skis each comprising a long and narrow board made of an elastic material;

boot fixtures installed on the central upper face of a central portion of said board in a longitudinal direction thereof;

at least two pairs of rollers disposed side by side and parallel on a central lower face of said central portion of said board so as to be directed in a rotating direction in the longitudinal direction of said board while having a left-right spacing corresponding to a width of said board and having a front-rear spacing shorter than a front-rear length of a boot secured to said boot fixtures, thereby to form a rectangular ground contact plane in which the ground contact points of said rollers serving as front wheels and said rollers serving as rear wheels are used as the apexes thereof; and two casters, a direction of which is changeable as desired, one being disposed on the lower face of a top portion of said board and the other being disposed on the lower face of a tail portion of said board, wherein when said board is placed on the ground with no load applied thereto, only the rollers of said front and tail casters make contact with the ground and said two pairs of rollers at the central portion are away from the ground, when load is applied to the central portion of the board on which said boot fixtures are secured, said two pairs of rollers receiving the load simultaneously come into contact with the ground, thus forming a rectangular ground contact plane in which ground contact points of said rollers serving as front wheels and said rollers serving as rear wheels are used as apexes thereof, and said casters, disposed at the top and tail portions of the board and constantly in touch with the ground irrespective of tilt of the board, elastically support, by a repulsive force of the board, the load applied to each of said casters, said casters changing direction thereof upon side slipping of the board so as not to hinder the side slipping movement.

2. The roller skis according to claim 1, wherein positions of said rollers of said two casters are selectively determined so that the distance from the lower face of said board to the ground contact points of said rollers of said casters is larger than the distance from the lower face of said board to the ground contact points of said two pairs of rollers, whereby when said board is placed on the ground with no load applied thereto, only said rollers of said top and tail casters make contact with the ground and said two pairs of rollers at the central portion are away from the ground.

3. The roller skis according to claim 1 or 2, wherein said board is curved so as to become convex upward, whereby when said board is placed on the ground with no load applied thereto, only said rollers of said top and tail casters make contact with the ground and said two pairs of rollers at the central portion are away from the ground.

* * * * *